United States Patent [19]

Underhill et al.

[11] Patent Number: 4,483,117

[45] Date of Patent: Nov. 20, 1984

[54] COMPOSITE GAMBREL ROOF TRUSS WITH PREFABRICATED TRUSS COMPONENTS

[75] Inventors: George R. Underhill; Magued Orfi, both of Elmira, N.Y.

[73] Assignee: Alpheus Finch Underhill, Elmira, N.Y.

[21] Appl. No.: 318,448

[22] Filed: Nov. 5, 1981

[51] Int. Cl.[3] ..... E04B 1/32

[52] U.S. Cl. ..... 52/639; 52/93

[58] Field of Search ..... 52/90–93, 52/639–644, 94; 403/283, 405, 408

[56] References Cited

U.S. PATENT DOCUMENTS

| | | | |
|---|---|---|---|
| 568,066 | 9/1896 | Cook | 52/643 |
| 1,367,510 | 2/1921 | Wilkens | 52/639 |
| 1,387,698 | 8/1921 | Erickson | 52/92 |
| 2,638,637 | 5/1953 | Kump, Jr. | 52/93 |
| 2,840,014 | 6/1958 | Wadsworth et al. | 52/639 |
| 3,031,727 | 5/1962 | Nesbitt | 52/639 |
| 3,059,293 | 10/1962 | Eddleblute | 52/639 |
| 3,479,783 | 11/1969 | Sureit | 52/639 |
| 3,849,961 | 11/1974 | Gwynne | 52/639 |
| 3,969,869 | 7/1976 | Partridge | 52/639 |

FOREIGN PATENT DOCUMENTS

| | | | |
|---|---|---|---|
| 807548 | 10/1948 | Fed. Rep. of Germany | 52/639 |
| 508398 | 10/1921 | France | 52/90 |
| 942168 | 1/1947 | France . | |
| 128901 | 4/1919 | United Kingdom . | |
| 885646 | 12/1961 | United Kingdom | 52/643 |

*Primary Examiner*—John E. Murtagh
*Assistant Examiner*—Andrew Joseph Rudy
*Attorney, Agent, or Firm*—Mattern, Ware, Stoltz & Fressola

[57] ABSTRACT

A composite gambrel roof truss assembly comprises a prefabricated top truss having a rigid lower chord and two top chords, all connected together to form a rigid triangular top truss unit, with two prefabricated side truss units, each having a rigid diagonal base chord and two outer top chords, all connected together to form a rigid triangular side truss unit whose topmost top chord is dimensioned to be juxtaposed in abutting mating relationship with a corresponding top chord of the top truss unit, and with connector means joining the topmost chord of each side truss unit with its abutting mating top chord of the top truss unit whereby the prefabricated top truss unit can be readily connected at a construction site to both of the side truss units to form a sturdy, rigid composite truss assembly capable of rapid installation by being hoisted bodily into position, and having a peak junction and two hip junctions producing an economical four-chord arched gambrel roof truss assembly of light weight with an unusually great clear height and span.

7 Claims, 4 Drawing Figures

COMPOSITE GAMBREL ROOF TRUSS WITH PREFABRICATED TRUSS COMPONENTS

TECHNICAL FIELD

The present invention relates to lightweight long span roof trusses, and particularly to gambrel-shaped roof trusses used to support gambrel roofs having a top central peak and at least one lower hip on each side of the peak, dividing each side of the sloping roof into two areas of different slopes.

BACKGROUND ART

Conventional roof trusses in the shape of a triangle have long been used to support ordinary peaked roofs having an inverted V-shape, with a single ridge or peak. Internal diagonals joining the peak to the horizontal lower base chord of each truss obstruct the open space inside the truss, and minimize the usefulness of the enclosed area directly under the roof.

Conventional roof framing trusses are highly economical when used for the construction of plain peaked roofs, but do not lend themselves to the construction of gambrel roofs. Moreover, an "inclined chord" highway bridge type truss may have horizontal lower chords and successively inclined upper chords forming a polygon-shaped outline which may resemble a gambrel, but such a truss is obstructed by many vertical and diagonal internal truss members, thus filling the volume under any overlying roof with truss members, which prevent practical use of the space for normal purposes.

In addition, trusses supporting the roofs of buildings enclosing piles of granular materials such as salt, sand, grain or powdered chemicals require a large open space extending to the maximum available clear height under the roof peak and extending laterally to the walls of the structure, without obstruction by horizontal truss chords or other truss members. Horizontal spans up to 60 feet are useful in material storage buildings of this kind, but costly roof supporting trusses of steel have been required to support roof spans of this size, making a sturdy and economical long span gambrel roof truss highly sought after.

DISCLOSURE OF THE INVENTION

In the roof trusses of the present invention spans up to 60 feet can be achieved using more economical timber as the truss material. Prefabricated top and side truss components which are joined together on site with minimum labor can then be hoisted into position to erect the entire roof-supporting truss framework in a single day, minimizing the cost of cranes or other hoisting systems employed for that purpose.

The gambrel roof trusses of this invention are composite trusses, being formed of separate, prefabricated smaller top and side truss units. These are economically stored and transported, and easily joined together to form low-cost, lightweight, long span truss assemblies.

The prefabricated components of the present invention facilitate assembly of the composite gambrel roof trusses herein disclosed, since all mating parts are precut and predrilled for ease of assembly at the construction site. Parts need not be changed or adjusted during assembly, and no assembly jigs are normally required.

Accordingly, it is a principal object of the present invention to provide lightweight and economical wide span composite gambrel roof trusses formed of prefabricated component trusses assembled in the field.

Another object of the present invention is to provide such gambrel roof trusses capable of easy field assembly without the necessity for assembly jigs.

Other objects of the invention will in part be obvious and will in part appear hereinafter.

The invention accordingly comprises the features of construction, combinations of elements, and arrangement of parts which will be exemplified in the constructions hereinafter set forth, and the scope of the invention will be indicated in the claims.

For a fuller understanding of the nature and objects of the invention, reference should be had to the following detailed description taken in connection with the accompanying drawings.

BEST MODE FOR CARRYING OUT THE INVENTION

Figure 1:
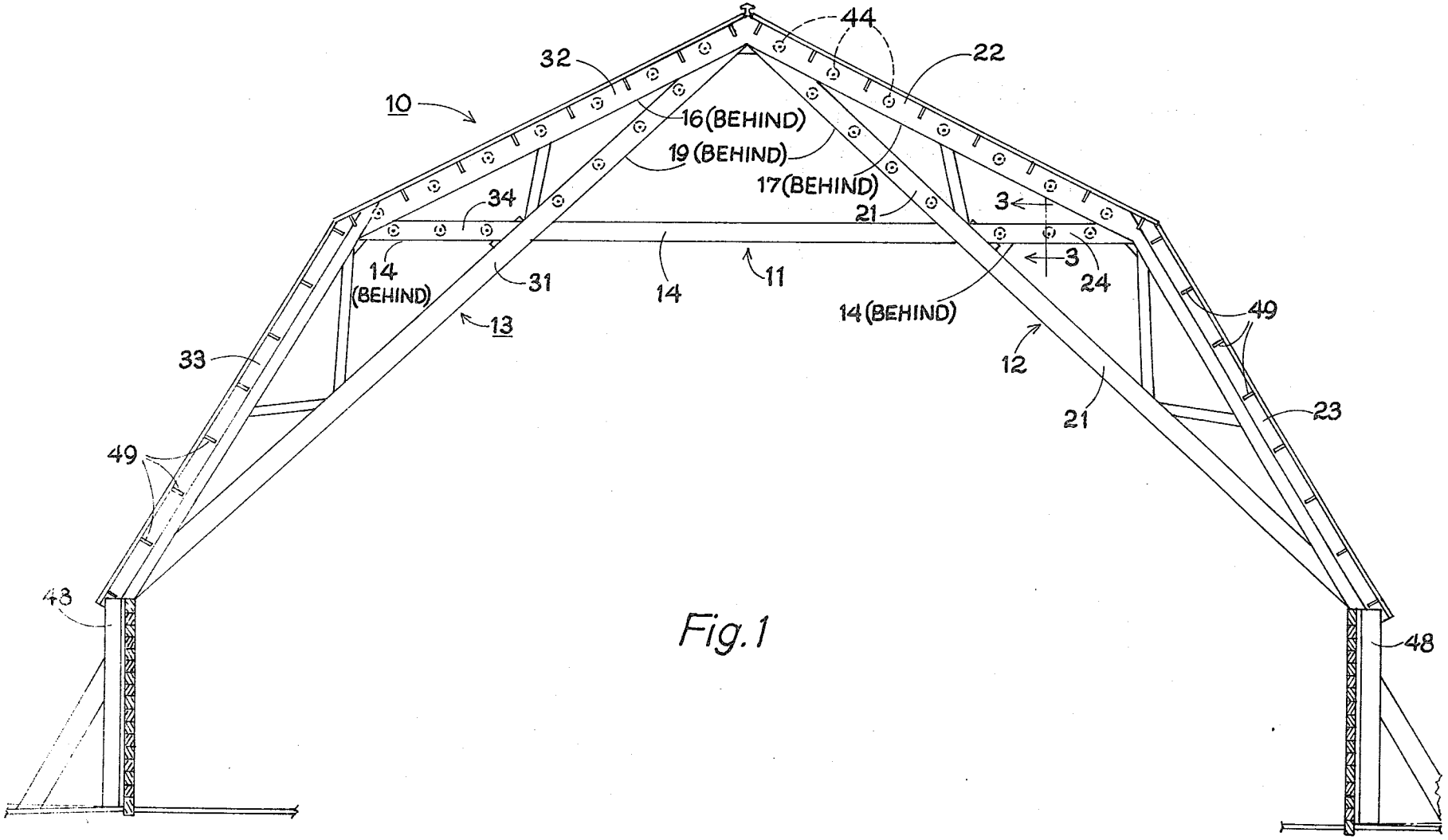
FIG. 1 is a cross-sectional elevation view of a gambrel roof structure incorporating a composite roof truss assembled from prefabricated top and side component trusses exemplifying the present invention.

In the preferred embodiment, the composite gambrel roof truss assembly 10 shown in the elevation view of FIG. 1 is composed essentially of three triangular trusses, a prefabricated top truss 11, a prefabricated right-hand truss side 12 and a prefabricated left-hand truss side 13. As indicated in the drawings, each of these individual trusses is preferably triangular in shape although other polygonal truss outlines could be used if desired. The use of the rigid lower chord in each of these triangular component trusses simplifies their maneuvering and juxtaposition with each other for easy and speedy assembly in the field.

Figure 4:
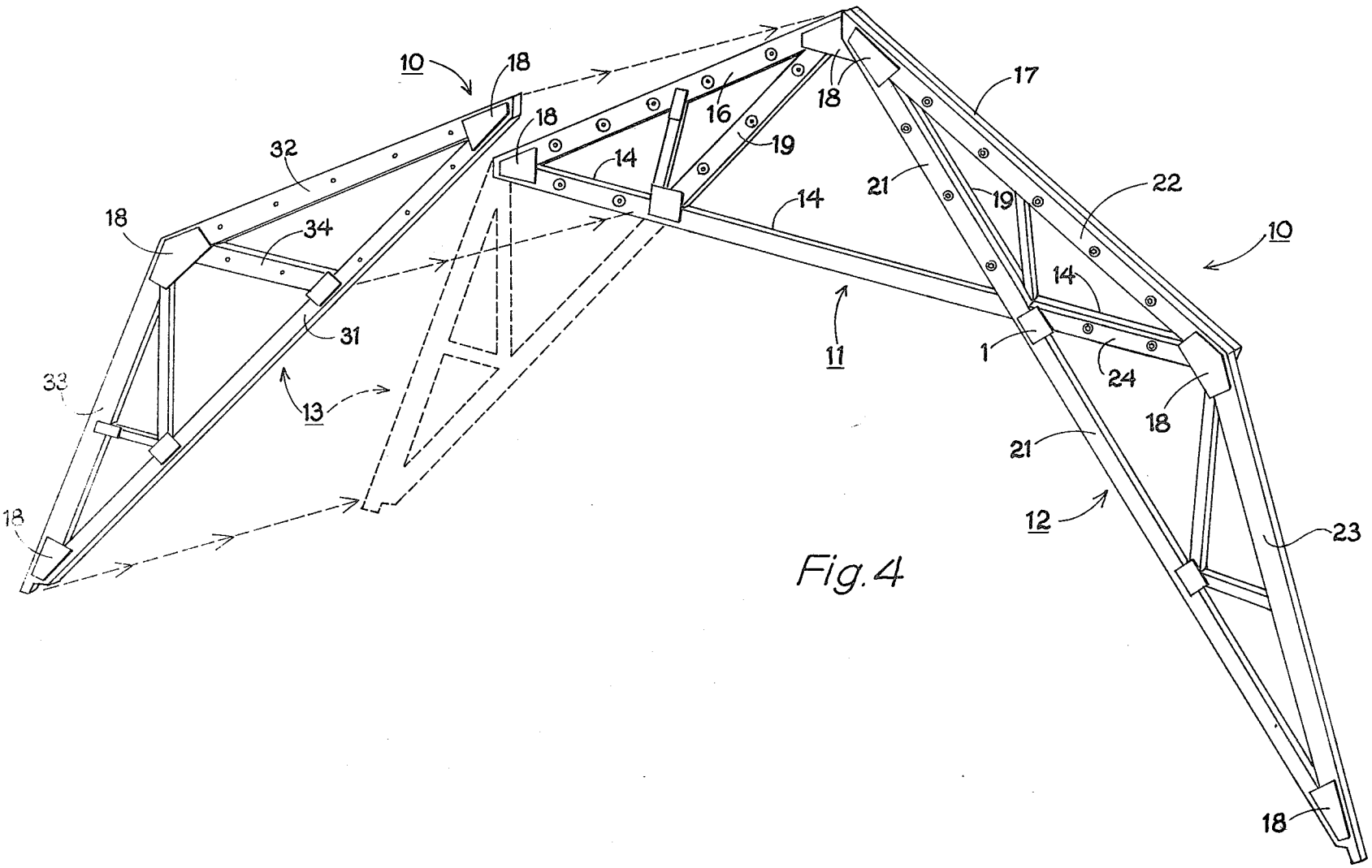
FIG. 4 is an exploded perspective view of a truss assembly of the present invention showing two component truss units already assembled together, with a third component truss unit in position, ready to be assembled therewith.

Top truss 11 is bounded by its rigid horizontal lower chord 14, it rigid diagonal upper left top chord 16, and its identical rigid right upper top chord 17, forming a top peak junction. As shown in FIG. 4, these chords 14, 16 and 17 are joined together at their ends by suitable plates 18 bolted or riveted in place.

Intermediate diagonal braces 19 extend from the top peak of the top truss 11 to respective intermediate points along the rigid lower chord 14, as illustrated in FIG. 4.

As shown in FIGS. 1 and 4, right-hand truss 12 is a similar truss, triangular in outline and composed of three comparable rigid chord members, a diagonal base chord 21, and upper top chord 22 and a lower top chord 23, all joined together at their ends to form a triangular truss by suitable bolted or riveted plates 18. The junction of the two top chords 22 and 23 at the gambrel hip junction or intermediate peak of the gambrel roof is joined if desired by a diagonal brace 24 extending therefrom to an intermediate point along the length of diagonal base chord 21 of the right-hand truss 12.

The left-hand truss 13 is similar in shape to the right-hand truss 12. As shown in FIG. 4, left-hand truss 13 is provided with a diagonal base chord 31, an upper top chord 32 and a lower top chord 33. If desired, a diagonal brace 34 joins the outer apex or hip junction of the two top chords 31 and 32 to an intermediate point along the length of the diagonal base chord 31.

The composite truss assembly shown in the drawings thus comprises the top truss unit 11 formed of three rigid chords 14, 16 and 17, joined to form a rigid triangular truss unit 11 having a peak junction and two hip junctions, joined to each of the side truss units 12 and 13 which are also formed of three rigid chords 21, 22 and 23 or 31, 32 and 33, joined to form a rigid triangular truss unit 12 or 13 with two outer top chords 22–23 or 32–33 joined to form a hip junction, and the topmost chord 22 or 32 of each side truss unit substantially co-extends in juxtaposition with a top chord 17 or 16 of the top truss unit 11 from the peak junction to one hip junction to produce a four-chord 33, 32(16), 22(17), 23 arched gambrel roof truss assembly.

By examination of the left side of FIG. 4, it will be noted that the upper apex angle of left-hand truss 13 formed by diagonal base chord 31 and upper top chord 32 is preferably identical to the angle formed between diagonal left top chord 16 and diagonal brace 19 of top truss 11.

It will likewise be noted that the angle between the rigid lower chord 14 of top truss 11 and the diagonal left top chord 16 at the left hand end of top truss 11 is preferably identical to the angle between upper top chord 32 and diagonal brace 34 of left-hand truss 33.

For this reason, when left-hand truss 13 is maneuvered into juxtaposition with top truss 11, reaching the dotted line position shown in FIG. 4, upper top chord 32 coincides with diagonal left top chord 16; diagonal base chord 31 coincides with diagonal brace 19 and diagonal brace 34 coincides with the abutting left end portion of rigid lower chord 14, thus forming a pair of identical congruent triangles in the juxtaposed overlapping portions of the two trusses 11 and 13.

The same congruent overlapping triangles will be observed in FIG. 4 at the overlapping portions of top truss 11 and right-hand truss 12, where diagonal right top chord 17 falls directly behind upper top chord 22, diagonal base chord 21 is positioned squarely in front of diagonal brace 19, and diagonal brace 24 lies directly in front of the abutting right end portion of rigid lower chord 14 in the upper right-hand portion of the composite truss assembly.

The lower ends of the two truss units 12, 13 may be mounted on walls 48, as shown in FIG. 1.

As indicated in the FIGURES, at least the uppermost sides and preferably all three sides of these congruent triangles are joined together by a plurality of timber connectors, when the prefabricated component trusses of the invention are formed of lightweight timbers in the preferred embodiment.

Figure 3:
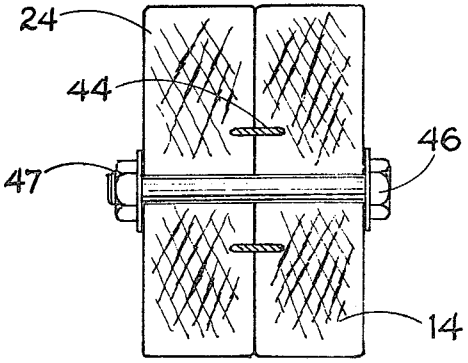
FIG. 3 is a cross-sectional elevation view of the assembled split-ring connector employed to join adjacent truss timbers, corresponding to the exploded view of FIG. 2.
Figure 2:
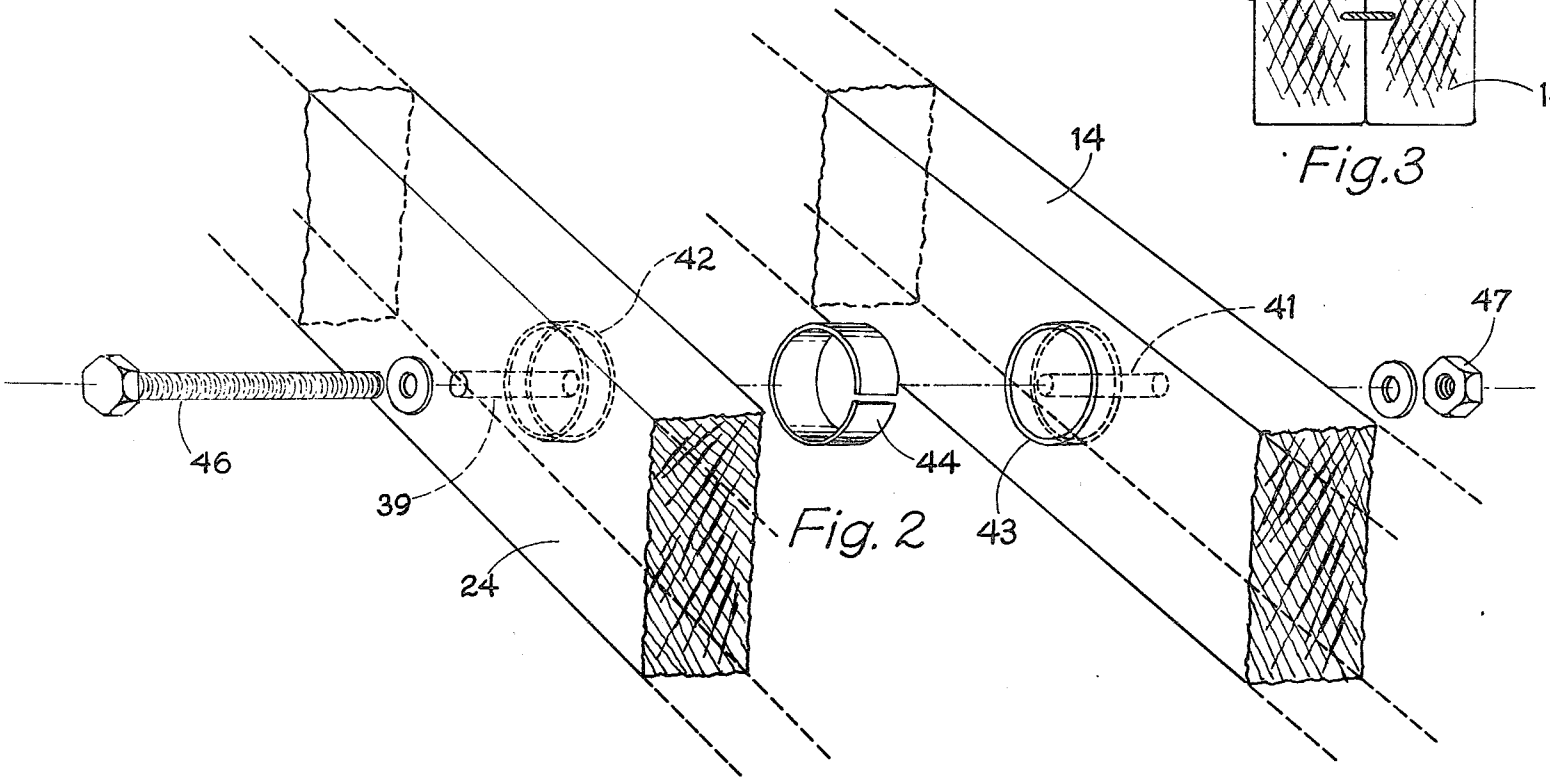
FIG. 2 is a fragmentary exploded perspective view of a split-ring connector employed to join and transmit stress between two adjacent truss timbers in the truss assemblies of the present invention.

The so-called "TECO" split-ring connectors originally manufactured under the now expired patents of the Timber Engineering Company of Washington, D.C. are the preferred form of timber connectors used in the preferred embodiments of the invention. As illustrated in FIGS. 2 and 3, these split-ring connectors generally indicated at 44 convey longitudinal stress from one overlapping timber to another by means of a ring partially embedded in a ring-shaped groove 38 routed in the facing surfaces of the two timbers, encircling a thru-bolt hole by which the timbers are assembled together in facing juxtaposed abutting relationship. Thus as illustrated in FIGS. 2 and 3 with reference to diagonal brace 24 and lower chord 14, a bolt hole 39 bored centrally and horizontally through timber 24 is aligned with a similar bolt hole 41 bored horizontally though timber 14.

A routing tool centered on the respective bolt holes is employed to rout a narrow circular groove approximately two and one-half inches in diameter, one-eighth inch in radial width and approximately three-eighths to one-half inch deep in each timber. According to one publication, the groove dimensions for two different sizes of "TECO" split ring connectors are the following:

| | | |
|---|---|---|
| Inside diameters of ring, closed | 2½" | 4" |
| Groove dimensions, inside diameter | 2.56" | 4.08" |
| Groove widths, in the radial direction | 0.18" | 0.21" |
| Groove depth | 0.37" | 0.50" |

The foregoing data is taken from the National Lumber Manufacturers Association publication "Manual of Timber Connector Construction", 1939 edition. The nominal two and one-half inch diameter split-ring connectors are suitable for use in the assemblies of the present invention and are readily accessible as commercially available products. The foregoing dimensions indicate that the split rings are pried open for insertion in the routed grooves, where they tend to spring closed to grip the inner groove wall in each timber.

As illustrated in FIG. 2, the routed grooves 42 and 43 in respective timbers 24 and 14 are formed directly facing each other where they can sandwich between themselves the split-ring 44 when the timbers are brought together in abutting juxtaposition. As indicated in FIG. 3, the timbers 14 and 24 sandwiching the split ring 44 are anchored together in this juxtaposed abutting position by a bolt 46 installed with suitable washers and a threaded nut 47.

Sheet metal joist hangers 49 preferably position joists between trusses, to carry the load of roof sheathing and roofing.

Stress analysis of the loads and stresses produced in the various chords and diagonal braces of the assembled composite truss of the present invention shows that normal dead and live loads customarily produce forces in the upper right and upper left top chord members which are about double those in the base chord members 31, 14 and 21. Since the top chord members are doubled, however, by the juxtaposition of the top truss with the two triangular component side trusses, timbers 17 and 22 are capable of sharing the double load, as are juxtaposed top chord timbers 16 and 32. The actual stresses in the various truss members are thus substantial equalized.

In order to spread the load evenly between these juxtaposed truss members 17 and 22 and 16 and 32, split ring connectors 44 such as those shown in FIGS. 2 and 3 are preferably installed embedded in the facing surfaces of these abutting juxtaposed timber members. Thus as shown in FIG. 1, a plurality of as many as seven top connectors 44 can be installed at spaced intervals along the juxtaposed length of the two timbers 17 and 22, and a corresponding plurality of top connectors can be installed along the juxtaposed length of timbers 16 and 32.

With heavier truss loadings and wider span trusses, additional split-ring diagonal connectors may be installed between the facing surfaces of abutting juxtaposed timbers 19 and 21 or 19 and 31; and also a plurality of lower connectors between 14 and 24 or 14 and 34, all as indicated in FIGS. 1 and 4. Tension and compression loads are directly transmitted from each timber to its adjacent timber through these split-ring connectors 44, substantially equalizing the loading to spread it in shared fashion between each juxtaposed pair of abutting timbers. Thus diagonal connectors join the right-hand diagonal brace 19 of top truss unit 11 to the abutting upper end of diagonal base chord 21 of the juxtaposed right side truss unit 12; and diagonal connectors join the left-hand diagonal brace 19 of top truss unit 11 to the abutting upper end of diagonal base chord 31 of the juxtaposed left side truss unit 13.

While trusses of various kinds are shown in a number of prior art patents, the only such truss even remotely comparable to the composite truss assemblies of the present invention is the proposal shown in British Pat. No. 128,901 of Gaston LeCocq , where overlapping triangles are arranged in the general configuration of the present invention to form gambrel roof-supporting truss assemblies. In the LeCocq proposal, however, all three lower chord members are illustrated as "ties" with adjustable extremities which are always in tension, according to Column 2, lines 50–53 of the LeCocq specification. These "ties" are presumably steel cables shortened by end turnbuckles, or equivalent flexible structures. Such limp flexible "tension" base chord members would require extremely expensive erection techniques, because no inversion of stresses can be permitted to occur in them, as specifically taught by LeCocq in Column 2, lines 48–49. Consequently, the compression frame comprising the outer truss chord members must have been set in place before the cables were installed. After installation, the cables must be tightened and supported against sagging before shoring or jacks under the compression section can be removed. After removal of the shoring, the cables would then go into permanent tension. This expensive and delicate maneuver is far different from the rapid assembly and quick erection techniques made possible by the present invention, in which these composite truss assemblies, fabricated from either wood or steel are constructed of three or more independent prefabricated triangular trusses, easily assembled on the ground and lifted in place as a finished truss unit of far greater height and span than its truss components. The split-ring shear connectors 44 employed with the present invention to tie juxtaposed truss members together allows stresses to be transferred throughout the truss as if it had been originally constructed as a single unit. The separate prefabricated component triangular truss units are easily stored and transported, and easily handled at the construction site. The top component truss 11 acts as a template for the two side truss components 12 and 13 which are easily maneuvered into position lying flat on top of the top truss 11, while all of these components are supported by the ground. All of the rigid base chords 14, 21 and 31 are capable of sustaining an inversion of stress from tension to compression. For this reason, the assembled composite gambrel roof supporting truss 10 of the present invention can be picked up after assembly by a crane, suspended in upright position from its topmost peak, with the bottom chords 14, 21 and 31 carrying compression dead loads created by the weight of the truss itself while it is lifted to the desired height and placed in position atop the supporting walls to complete the building structure shown in FIG. 1. Thus, the trusses of the present invention are surprisingly economical, and are capable of spanning much greater distances than conventional trusses. They provide greater clear height from floor to ceiling than any conventional timber wood truss structures.

It will thus be seen that the objects set forth above, among those made apparent from the preceding description, are efficiently attained and, since certain changes may be made in the above constructions without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

We claim:

1. A composite truss assembly comprising:

A. a prefabricated top truss unit formed of three rigid chords, a rigid lower chord and two rigid top chords, all connected together to form a rigid triangular top truss unit having a peak junction and two hip junctions, B. two independent prefabricated side truss units, each also formed of three rigid chords joined to form a rigid triangular side truss unit with a rigid diagonal base chord and two outer top chords joined to form a hip junction, with the uppermost ends of the two side truss units positioned near the peak junction, and wherein the topmost chord of each side truss unit substantially co-extends in juxtaposition with a top chord of the top truss unit from the peak junction to one hip junction to produce a four-chord arched gambrel roof truss assembly, and C. a plurality of spaced top connector means joining the topmost chord of each side truss unit with its abutting mating top chord of the top truss unit at a plurality of points along their juxtaposed lengths, whereby the prefabricated top truss unit can be readily connected at a construction site to both of the side truss units to form a sturdy, rigid composite truss assembly capable of rapid installation by being hoisted bodily into position.

2. The composite roof truss assembly defined in claim 1, wherein each side truss unit includes a diagonal brace joining the hip junction of its two outer top chords to an intermediate point on its diagonal base chord, with the intermediate point being selected to position the diagonal brace in substantially parallel abutting juxtaposition with a portion of the rigid lower chord of the top unit when the side truss units are joined to the top truss unit.

3. The composite roof truss assembly defined in claim 2, further including lower connector means joining each diagonal brace to the abutting portion of the rigid lower chord of the top unit.

4. The composite truss assembly defined in claim 1, wherein the top unit includes two diagonal braces, each joining the peak junction to intermediate points on the rigid lower chord, with the intermediate points being selected to position each diagonal brace in substantially parallel abutting juxtaposition with a portion of the rigid diagonal base chord of one of the side units when the side truss units are joined to the top truss unit.

5. The composite roof truss assembly defined in claim 4, further including diagonal connector means joining each diagonal brace to the abutting portion of the rigid diagonal base chord of its juxtaposed side truss unit.

6. The composite roof truss assembly defined in any one of claims 1, 2 or 4 wherein the connector means are defined as split-ring connectors partially embedded in mating ring-shaped grooves routed in facing abutting surfaces of the top truss unit and a side truss unit, each encircling a through bolt joining the truss units in juxtaposed assembled relationship.

7. The composite truss unit defined in claim 1, wherein the juxtaposed abutting mating chords are formed of timber, and the connector means are split-ring connectors interposed therebetween and partially embedded therein.

* * * * *